United States Patent [19]

Forss et al.

[11] 4,306,230

[45] Dec. 15, 1981

[54] SELF-CHECKING PHOTOELECTRIC SMOKE DETECTOR

[75] Inventors: John A. Forss, Excelsior; Stephen A. Haglund, Minnetonka, both of Minn.

[73] Assignee: Honeywell Inc., Minneapolis, Minn.

[21] Appl. No.: 101,619

[22] Filed: Dec. 10, 1979

[51] Int. Cl.[3] ..... G08B 17/10

[52] U.S. Cl. ..... 340/630; 250/574; 340/636; 356/439

[58] Field of Search ..... 340/531, 629, 630, 632, 340/636, 659; 250/574, 573; 356/438, 439

[56] References Cited

U.S. PATENT DOCUMENTS

| | | | |
|---|---|---|---|
| 1,828,894 | 10/1931 | Freygang | 250/574 |
| 2,877,453 | 3/1959 | Mendenhall, Jr. | 340/630 |
| 3,417,392 | 12/1968 | Hansen, Sr. et al. | 340/630 |
| 3,728,615 | 4/1973 | Hill et al. | 340/632 |
| 3,808,534 | 4/1974 | Summers et al. | 340/636 |
| 3,879,717 | 4/1975 | Gruensfelder | 340/531 |
| 4,001,800 | 1/1977 | Franks | 340/630 |
| 4,081,795 | 3/1978 | Ogawa | 340/629 |
| 4,099,178 | 7/1978 | Ranney et al. | 340/630 |
| 4,121,110 | 10/1978 | Solomon | 250/574 X |
| 4,144,458 | 3/1979 | Doherty | 250/574 |
| 4,144,459 | 3/1979 | Malinowski | 250/574 |

FOREIGN PATENT DOCUMENTS

| | | | |
|---|---|---|---|
| 7713605 | 8/1979 | Sweden | 340/659 |
| 1313877 | 4/1973 | United Kingdom | 356/438 |

*Primary Examiner*—John W. Caldwell, Sr.
*Assistant Examiner*—Daniel Myer
*Attorney, Agent, or Firm*—Trevor B. Joike

[57] ABSTRACT

A photoelectric smoke detector for providing indications of both alarm and trouble conditions is disclosed having a source of light, a detector apparatus having a light responsive device, said detector apparatus providing an output subject to a first change dependent upon the presence of smoke, the smoke detector further having a housing for mounting the source of light and the light responsive device, the housing having light path means for allowing light from the source of light to fall upon the light responsive device, the output from the detector apparatus being subject to a second change dependent upon trouble conditions, a first level sensor responsive to the first change to provide an alarm indication, and a second level sensor responsive to the second change to provide a trouble indication.

12 Claims, 4 Drawing Figures

SELF-CHECKING PHOTOELECTRIC SMOKE DETECTOR

BACKGROUND OF THE INVENTION

The present invention relates to photoelectric smoke detectors and, more particularly, to photoelectric smoke detectors which are capable of detecting their own deteriorating operability.

In recent years there has been a considerably increased awareness of detecting residential and commercial building fires. Among the many types of fire detectors presently available today, the predominant fire detector is the smoke detector. Smoke detectors rely either upon ionization chambers which utilize a radioactive source for ionizing air to establish a current path between two electrodes and for detecting a decrease in current in the presence of smoke or the photoelectric detector which utilizes a light source and a light responsive device for detecting particles of smoke. Photoelectric detectors in turn are of two basic types. The obscuration detector aligns the light source and light responsive device directly opposite one another and relies upon smoke to interfere with the light falling onto the light responsive device from the light source to change the output from the light responsive device and provide the alarm signal. The second type of smoke detector is the light scattering type which aligns the light source and the light responsive device at an angle with respect to one another so that light from the light source does not fall directly upon the light responsive device; but in the presence of smoke, light is scattered off of the smoke particles and falls on the light responsive device to provide an alarm indication.

In photoelectric smoke detectors, a reduction in source light output or a dirt deposit on the light source or the light sensor will cause the detector to become less sensitive to smoke. The prior art has provided various arrangements for detecting such problems. One such arrangement relies upon a light source and two photocells, one photocell for detecting the presence of smoke and the other photocell for monitoring the optical system itself. The problem with this arrangement is that it requires the use of two photocells and the monitoring photocell does not detect the case where dirt has built up over the detecting photocell. Another such arrangement utilizes a push-to-test feature. In this arrangement, a manually operable lever either scatters light in a light scattering photoelectric detector or obscures light in an obscuration photoelectric detector for simulating a smoke condition. However, this arrangement is not continuously checking and relies upon more complex mechanically movable parts. Still another such arrangement relies upon two different optical paths, one directly from a light source to a light detector and one scattered by smoke particles, but in which both paths are chopped to differentiate between the light received from the monitoring path and the light received from the detecting path. This arrangement requires the use of a more complex light chopper. Still another arrangement useful in a light scattering type photoelectric smoke detector provides a monitoring path between the light source and the light detector. A push-to-test lever normally blocks the light from following this monitoring path but, during a test operation, the lever is operated to allow light from the source to impinge upon the light responsive device to thus test the operability of the optical system. However, this arrangement again relies upon more complex and less economical mechanically movable parts.

SUMMARY OF THE INVENTION

The present invention solves many of the problems of the prior art arrangements by providing a source of light, a light responsive device, a housing for mounting the source of light and light responsive device, the housing having a light path for allowing light from the source of light to fall upon the light responsive device, a first level detector responsive to a first change in the output from the light responsive device indicative of smoke to provide an alarm indication, and a second level detector responsive to a second change in the output from the light responsive device indicative of trouble conditions for providing a trouble indication.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
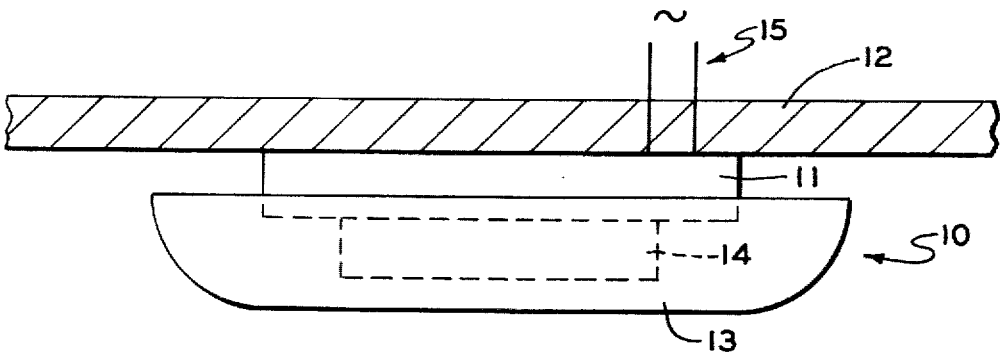
FIG. 1 shows the photoelectric detector mounted to a ceiling.

In FIG. 1, photoelectric smoke detector 10 comprises base 11 mounted to ceiling 12 by any suitable means and having cover 13 suitably attached thereto. Mounted on base 11 is sensing head 14 shown in more detail in FIG. 2. Base 11 can house the horn for providing the alarm and trouble indications as well as the electronics connected between the sensing head 14 and the horn. In the case where photoelectric detector 10 is an AC model photoelectric detector, AC lines 15 are provided through ceiling 12 to provide power for photoelectric detector 10. It is to be noted that photoelectric detector 10 may also be a battery operated unit in which case lines 15 are unnecessary.

Figure 2:
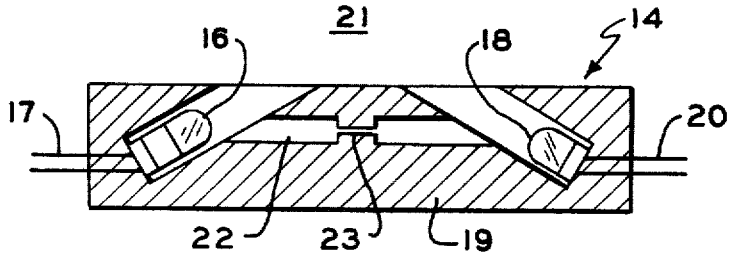
FIG. 2 is a cross-sectional diagram of the sensing head of the photoelectric detector shown in FIG. 1.

In FIG. 2, sensing head 14 comprises housing 19 for mounting therein light source 16 which may be in the form of a light emitting diode and supplied with power from lines 17. Light responsive device 18 is also mounted within housing 19 and has a pair of output leads 20 extending therefrom for providing an output signal based upon the amount of light received by light responsive device 18. As can be seen in FIG. 2, light source 16 and light responsive device 18 are angularly mounted in a light scattering mode. When smoke enters area 21, light will reflect off of the particles of smoke and impinge upon light responsive device 18 for providing a change in the output on lines 20. Also provided within housing 19 is channel 22 having an orifice 23 of a size for permitting a predetermined amount of light to directly fall upon light responsive device 18 from light source 16.

Figure 3:
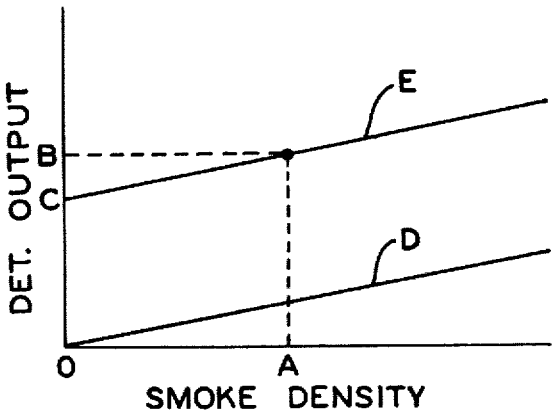
FIG. 3 shows the output from the light responsive device of FIGS. 1 and 2.

As shown in FIG. 3, this predetermined amount of light impinging upon light responsive device 18 adjusts the output therefrom on output lines 20 to point C in clear air. Without channel 22 and orifice 23, curve D represents the change in detector output, i.e. the output from photoresponsive device 18, in response to increasing smoke density. The channel 22 and orifice 23 arrangement shifts the detector output curve by an amount C, in clear air, to curve E. In this graph, point A represents the level of smoke density at which an alarm is desired to be given. Point B represents the detector output for this amount of smoke. Thus, the circuit arrangement of FIG. 4 will sound the alarm whenever the smoke density increases above level A and the detector output increases above point B, and will provide a trouble indication when the detector output falls below point C as it may do when dirt accumulates either on the light source or the light responsive device, or if the light source suffers a reduction of its light output as a function of age.

Figure 4:
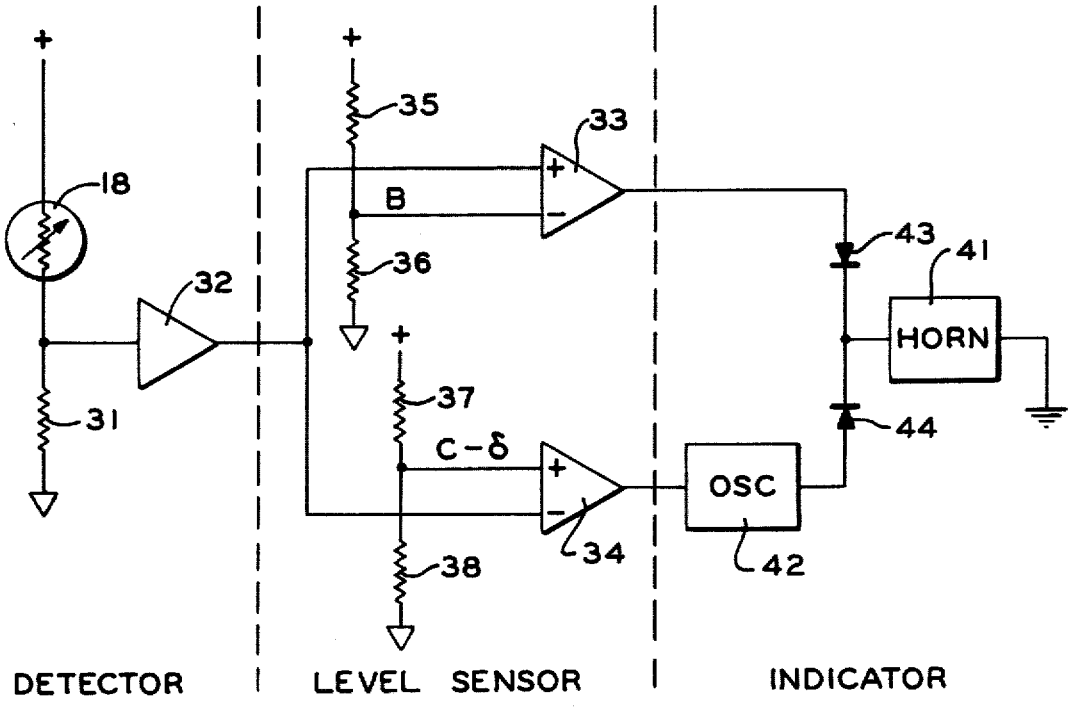
FIG. 4 shows the level detectors useful in detecting the alarm and trouble conditions.

In FIG. 4, the detector portion comprises light responsive device 18 having one side connected to a source of positive potential and the other side connected through resistor 31 to ground. The junction of light responsive device 18 and resistor 31 is amplified by any suitable amplifier and processor 32. The level sensor comprises operational amplifier 33 having its positive input connected to the output of amplifier 32, and operational amplifier 34 having its negative input connected to the output of amplifier 32. The level detector also comprises series connected resistors 35 and 36 connected between a positive source and ground and having their common junction connected to the negative input terminal of operational amplifier 33 as well as series connected resistors 37 and 38 connected between a positive source and ground and having their common junction connected to the positive input of operational amplifier 34. The output of amplifier 33 is used to control horn 41 and the output of amplifier 34 controls horn 41 through oscillator 42.

The junction of resistors 35 and 36 is established at level B. Thus, as smoke begins entering photoelectric smoke detector 10 and specifically area 21, light is reflected from light source 16 to light responsive device 18 by the particles of smoke. As the smoke density increases, the output from amplifier 32 will increase until it reaches level B. At level B, amplifier 33 will switch to turn on horn 41 to provide an alarm indication. On the other hand, if light source 16 begins to fail or if dirt builds up on light source 16 or photoresponsive device 18, the output from amplifier 32 will begin to fall. When it falls below level C by a small amount $\delta$ which is established by the junction of resistors 37 and 38, amplifier 34 will switch to energize horn 41 through oscillator 42. Oscillator 42 will insure that horn 41 will provide a different sound pattern so that the trouble indication can be distinguished from the alarm indication. Diodes 43 and 44 decouple oscillator 42 and amplifier 33.

The circuit of FIG. 4 can be used either in an AC detector or a battery detector. In the case of a battery detector the circuit should be pulsed to conserve battery energy; thus, it may be necessary to provide a latch at the output of amplifier 34 such that oscillator 42 will be continuously energized during trouble conditions.

The embodiments of the invention in which an exclusive property or right is claimed are defined as follows:

1. A photoelectric smoke detector for providing indications of both alarm and trouble conditions comprising:

a source of light;

detector means having a light responsive device, said detector means providing an output subject to a first change dependent upon said alarm conditions;

a housing for mounting said source of light and said light responsive device, said housing comprising substantially direct and straight through light path means for passing light from said source of light to said light responsive device in a substantially direct and straight through light path, said output being subject to a second change dependent upon said trouble conditions;

first level sensing means responsive to said first change to provide an alarm indication; and, second level sensing means responsive to said second change to provide a trouble indication.

2. The detector of claim 1 wherein said source of light and said light responsive device are mounted within said housing at an angle with respect to one another so that said light responsive device receives light scattered by smoke entering said smoke detector and said light path means comprises an orifice extending from said source of light through said housing to said light responsive device for establishing said output from said detector means at a predetermined level.

3. The detector of claim 2 wherein said first and second level sensing means comprises first and second amplifiers connected between said detector means and an indicator.

4. The detector of claim 3 wherein said first and second amplifiers each comprises positive and negative inputs, said positive input of said first amplifier and said negative input of said second amplifier being connected to said detector means, said negative input of said first amplifier being connected to a voltage divider for establishing the smoke level at which said alarm indication is provided, and said positive input of said second amplifier being connected to a voltage divider for establishing the level below which said trouble indication is provided.

5. The detector of claim 1 wherein said first and second level sensing means comprises first and second amplifiers connected between said detector means and an indicator.

6. The detector of claim 5 wherein said first and second amplifiers each comprises positive and negative inputs, said positive input of said first amplifier and said negative input of said second amplifier being connected to said detector means, said negative input of said first amplifier being connected to a voltage divider for establishing the smoke level at which said alarm indication is provided, and said positive input of said second amplifier being connected to a voltage divider for establishing the level below which said trouble indication is provided.

7. A photoelectric smoke detector for providing indications of both alarm and trouble conditions comprising:

a source of light;

detector means having a light responsive device;

a housing for mounting said source of light and said light responsive device, said housing comprising substantially direct and straight through light path means for passing light from said source of light to said light responsive device in a substantially direct and straight through light path to establish a predetermined output from said detector means;

first level sensing means connected to said detector means and responsive to a change in said output from said detector means in a first direction to provide an alarm indication; and, second level sensing menas connected to said detector means and responsive to a change in the output from said detector means in a second direction to provide a trouble indication.

8. The detector of claim 7 wherein said source of light and said light responsive device are mounted within said housing at an angle with respect to one another so that said light responsive device receives light scattered by smoke entering said smoke detector and said light path means comprises an orifice extending from said source of light through said housing to said light responsive device for establishing said predetermined output.

9. The detector of claim 8 wherein said first and second level sensing means comprises first and second amplifiers connected between said detector means and an indicator.

10. The detector of claim 9 wherein said first and second amplifiers each comprises positive and negative inputs, said positive input of said first amplifier and said negative input of said second amplifier being connected to said detector means, said negative input of said first amplifier being connected to a voltage divider for establishing the smoke level at which said alarm indication is provided, and said positive input of said second amplifier being connected to a voltage divider for establishing the level below which said trouble indication is provided.

11. The detector of claim 7 wherein said first and second level sensing means comprises first and second amplifiers connected between said detector means and an indicator.

12. The detector of claim 11 wherein said first and second amplifiers each comprises positive and negative inputs, said positive input of said first amplifier and said negative input of said second amplifier being connected to said detector means, said negative input of said first amplifier being connected to a voltage divider for establishing the smoke level at which said alarm indication is provided, and said positive input of said second amplifier being connected to a voltage divider for establishing the level below which said trouble indication is provided.

* * * * *